US006233754B1

(12) United States Patent
Ajima

(10) Patent No.: US 6,233,754 B1
(45) **Date of Patent: *May 22, 2001**

(54) SWIMMING POOL

(75) Inventor: Toshio Ajima, Iwaki (JP)

(73) Assignee: Rika Kogyo, Inc. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/552,374

(22) Filed: Apr. 19, 2000

Related U.S. Application Data

(63) Continuation of application No. 09/294,496, filed on Apr. 20, 1999, now Pat. No. 6,151,726.

(30) Foreign Application Priority Data

Apr. 22, 1998 (JP) ..... 10-111858

(51) Int. Cl.[7] ..... E04H 4/00

(52) U.S. Cl. ..... 4/488; 4/507; 4/509; 4/512; 4/904

(58) Field of Search ..... 4/488, 489, 491, 4/507, 510, 511, 512, 541.1, 904

(56) References Cited

U.S. PATENT DOCUMENTS

| | | | |
|---|---|---|---|
| 1,585,736 | 5/1926 | Rohmer | 4/511 |
| 4,001,899 | 1/1977 | Mathis | 4/904 |
| 4,522,535 | 6/1985 | Bastenhof | 4/491 |
| 4,903,352 | 2/1990 | Murakami | 4/492 |
| 5,058,219 * | 10/1991 | Teratsuji et al. | 4/488 |
| 5,098,222 * | 3/1992 | Robinson | 4/491 |
| 5,186,578 * | 2/1993 | Perslow | 4/491 |
| 5,415,221 | 5/1995 | Zakryk | 4/509 |
| 5,535,702 * | 7/1996 | Idbeis | 4/491 |
| 5,758,369 | 6/1998 | Takahashi et al. | 4/488 |
| 5,787,519 | 8/1998 | Smith | 4/488 |

FOREIGN PATENT DOCUMENTS

| | | | |
|---|---|---|---|
| 681070 * | 2/1964 | (CA) | 4/904 |
| 24481 * | 12/1962 | (DE) | 4/488 |
| 5-340117 | 12/1993 | (JP) . | |
| 9-78865 | 3/1997 | (JP) . | |

OTHER PUBLICATIONS

Japanese Abstract, application 09078865, Mar. 1997.*
Japanese Abstract, application 05340117, Dec. 1993.*

* cited by examiner

*Primary Examiner*—Charles R. Eloshway
(74) *Attorney, Agent, or Firm*—Baker & Daniels

(57) ABSTRACT

A swimming pool includes a swimming tank, which stores water for swimming; and an upstream tank, which stores water to be supplied into the swimming tank. The pool further includes a downstream tank, which stores the water streamed from the upstream tank through the swimming tank; and a pump, which forces the water stored in the downstream tank to the upstream tank. The water in the upstream tank has an energy head that is higher than the water in the swimming tank so as to generate water current in the swimming tank.

14 Claims, 4 Drawing Sheets

SWIMMING POOL

CROSS REFERENCE TO RELATED APPLICATION

This is a continuation of application Ser. No. 09/294,496, filed Apr. 20, 1999, now U.S. Pat. No. 6,151,726.

This application claims the priority of Application No. H10-111858, filed Apr. 22, 1998 in Japan, the subject matter of which is incorporated herein by reference.

TECHNICAL FIELD OF THE INVENTION

The present invention relates to a compact swimming pool, which is designed to have a size that is enough large for swimming. More particularly, the present invention relates to a circulation type of swimming pool, in which water flows at an optimum speed. The stream (water current) along the surface of the water is well regulated to have a uniform flow rate throughout in the width direction.

BACKGROUND OF THE INVENTION

A variety of types of streaming swimming-pools have been invented. In most conventional streaming swimming-pools, water current is generated with screw blades. For example, in Japanese Patent Laying Open Kokai No. H05-340117, a screw type of water current generator is arranged at one end of the swimming pool.

According to such a water current generator, water is pushed out by rotation of the screw blades. For that reason, the generated water current becomes to be a turbulent flow; and therefore, it is difficult to provide a uniform flow rate along the width direction, which is orthogonal to the flowing direction. That is, the water current is a spiral stream, so that a different type of water current is generated in the bottom-to-surface direction. It looks like the water is agitated in the swimming pool. It is difficult to regulate the water current well around the surface of the water.

Further, according to the conventional technology, a large amount of frictional drag is made between the screw blades and the water. As a result, it is required to use a large capacity of motor in order to provide enough energy of water current. In addition, to provide much energy of water current, the screw blades are rotated at a high speed. Such a high-speed rotation of screw blades results in cavitation, which makes noise and vibration.

In order to well regulate the water current in a swimming pool, another type of invention is described in Japanese Patent Laying Open Kokai No. H09-78865. According to the invention, partition walls are arranged at a water supply opening to regulate the water current. However, the water current is still generated using screw blades, therefore above mentioned problems can not be solved yet. If the partition walls are arranged to have a narrower distance between each two adjacent walls, the resistance against the water is increased.

According to the conventional technology, a streaming type of swimming pool includes a drain opening or receiving opening at the downstream end, facing a water supply opening at the upstream end. In the conventional swimming pool, the water travels from the upstream and to the downstream end, and a part of the water is reflected at an end wall of the downstream end. The reflected water current interferes with the forward water current, so that complicated water current may be generated in the swimming pool (swimming tank).

OBJECTS OF THE INVENTION

Accordingly, an object of the present invention is to provide a swimming pool, in which the optimum flow rate can be obtained with a small power of driving device, such as a pump.

Another object of the present invention is to provide a swimming pool, which generates a well regulated water current having a uniform flow rate along the width direction.

Still another object of the present invention is to provide a swimming pool that generates a water current (forward stream), which is not interfered with a reflected water current (backward stream).

Additional objects, advantages and novel features of the present invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

According to the present invention, a swimming pool includes a swimming tank, which stores water for swimming; an upstream tank, which stores water to be supplied into the swimming tank; a downstream tank, which stores the water streamed from the upstream tank through the swimming tank; and a pump, which forces the water stored in the downstream tank to the upstream tank. The water in the upstream tank has an energy head that is higher than the water in the swimming tank so as to generate water current in the swimming tank.

In operation, enough amount of water is stored each in the swimming tank, upstream tank and downstream tank, in advance of use. Then, the pump is driven to circulate the water in those three tanks. According to the present invention, the water in the upstream tank has an energy head that is higher than the water in the swimming tank, so that the water in the upstream tank is injected into the swimming tank in accordance with the difference of energy head between those two tanks. The injected water makes water current that is not in a spiral state but in a laminar flow (streamline flow) state. In the swimming tank, the water current (laminar flow) travels along the surface of the water toward the downstream tank.

The energy head of the water in the upstream tank may include position head and pressure head.

The swimming pool may further include a supply opening, which is arranged between the upstream tank and swimming tank, so that the water stored in the upstream tank is injected through the supply opening to around the surface of the water in the swimming tank.

The swimming pool may further include a weir, which is arranged at the downstream end of the swimming tank. The downstream tank stores the water streamed over the weir. The weir may be shaped to have a top, which is curved upwardly. With such a curved top of weir, the water current reached there is smoothly guided toward the downstream tank but not reflected much. Therefore, the water current in the swimming tank is prevented from being disturbed by reflection current.

The swimming pool may further include a protector, which is arranged at the upstream end of the weir, so that the user in the swimming tank is protected from being accidentally flowed over the weir toward the downstream tank.

The swimming pool may further include a filter arranged on the water way between the downstream tank and the upstream tank to clean up the circulated water; a sterilizer arranged on the water way between the downstream tank and the upstream tank to sterilize the circulated water; and a heater arranged on the water way between the downstream tank and the upstream tank to control the temperature of the circulated water.

The upstream tank is of closed type and is controlled to add pressure to the water therein.

The supply opening may include a plurality of openings, which are arranged horizontally to have an optimum distance between two adjacent openings, the distance being not uniform throughout. Preferably, the distance is determined, in the horizontal direction, to be wider around the center of the swimming tank and be narrower around the sides of the swimming tank. Further, each of the openings may be designed to have an optimum area, which is not uniform throughout all the openings. The area of each opening may be determined, in the horizontal direction, to be larger around the center of the swimming tank and be smaller around the sides of the swimming tank.

When the distance of the openings is determined to be wider around the center of the swimming tank and be narrower around the sides, more amount of water flows around the sides of the swimming tank. As a result, frictional drag made around the side walls of the swimming tank is cancelled; and therefore, the water current runs at a uniform speed throughout the swimming tank.

On the other hand, when the area of each opening is determined to be larger around the center of the swimming tank and be smaller around the sides of the swimming tank, the water current tends to run at a higher speed around the sides of the swimming tank as compared to around the center. As a result, frictional drag made around the side walls of the swimming tank is cancelled, and therefore, the water current runs at a uniform speed throughout the swimming tank.

DETAILED DISCLOSURE OF THE INVENTION

Figure 1:
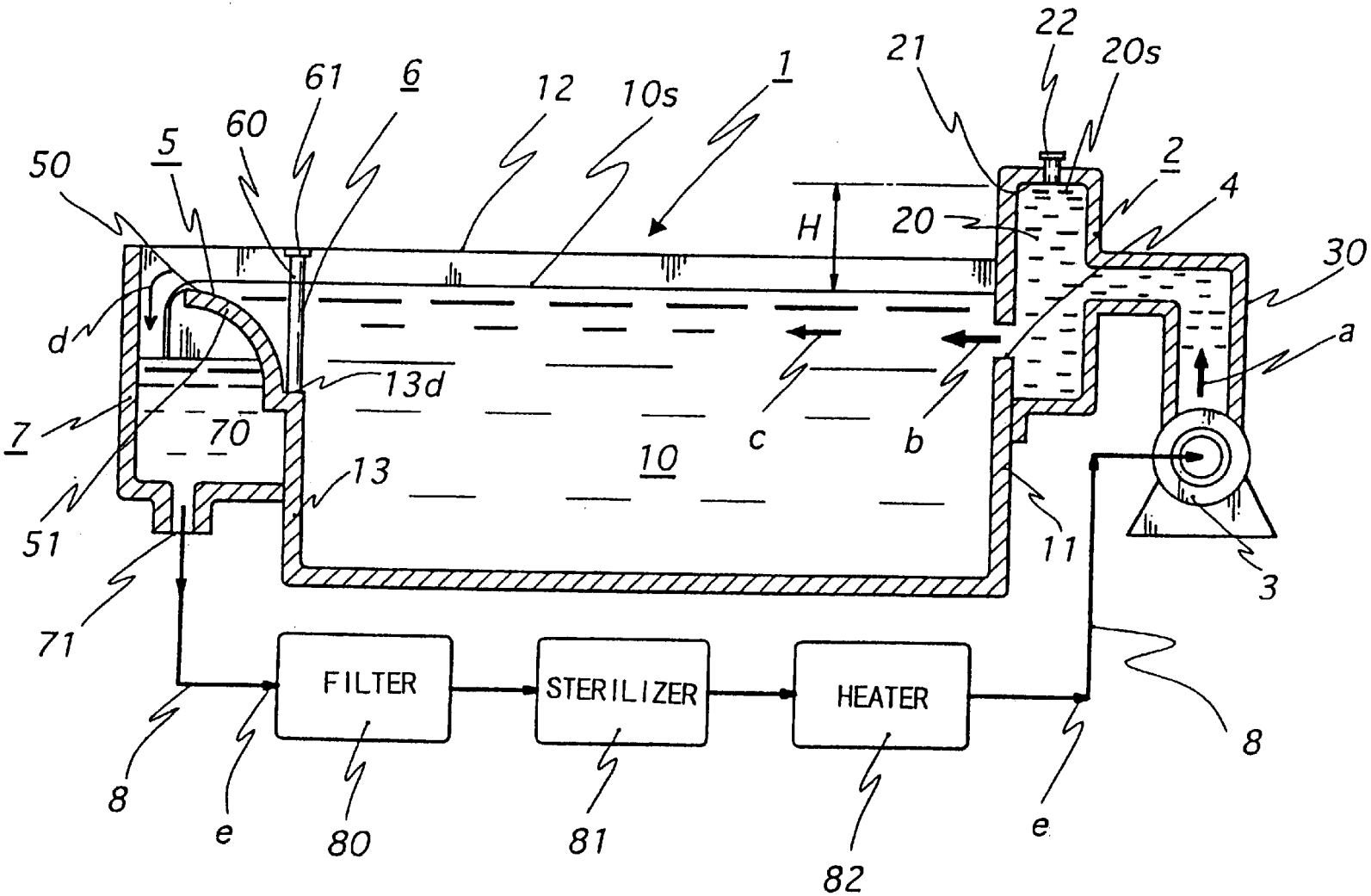
FIG. 1 is a side view (partly cross-sectional) illustrating a swimming pool according to a preferred embodiment of the present invention.
Figure 2:
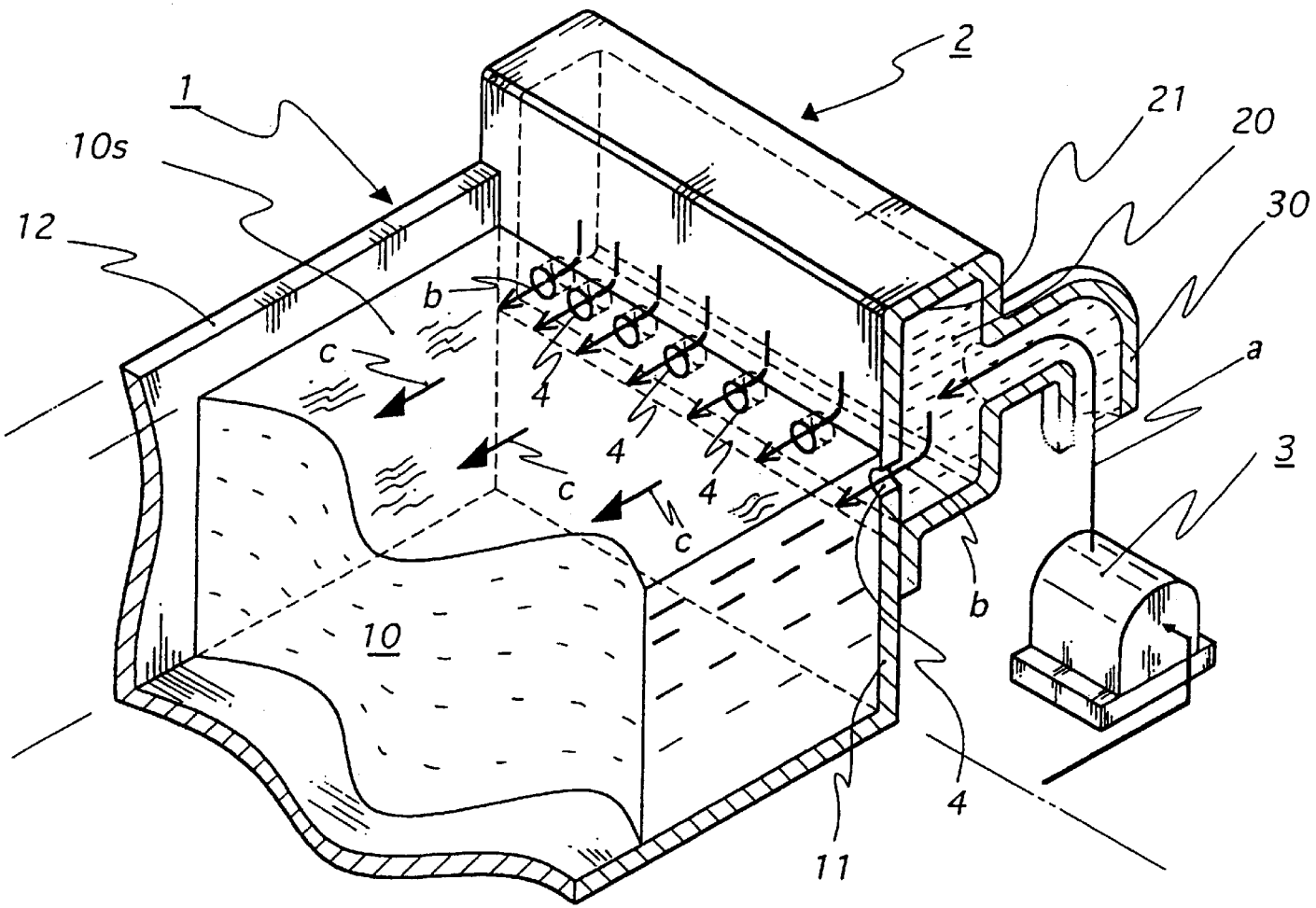
FIG. 2 is a perspective view illustrating an upstream part of the swimming pool, shown in FIG. 1.
Figure 3:
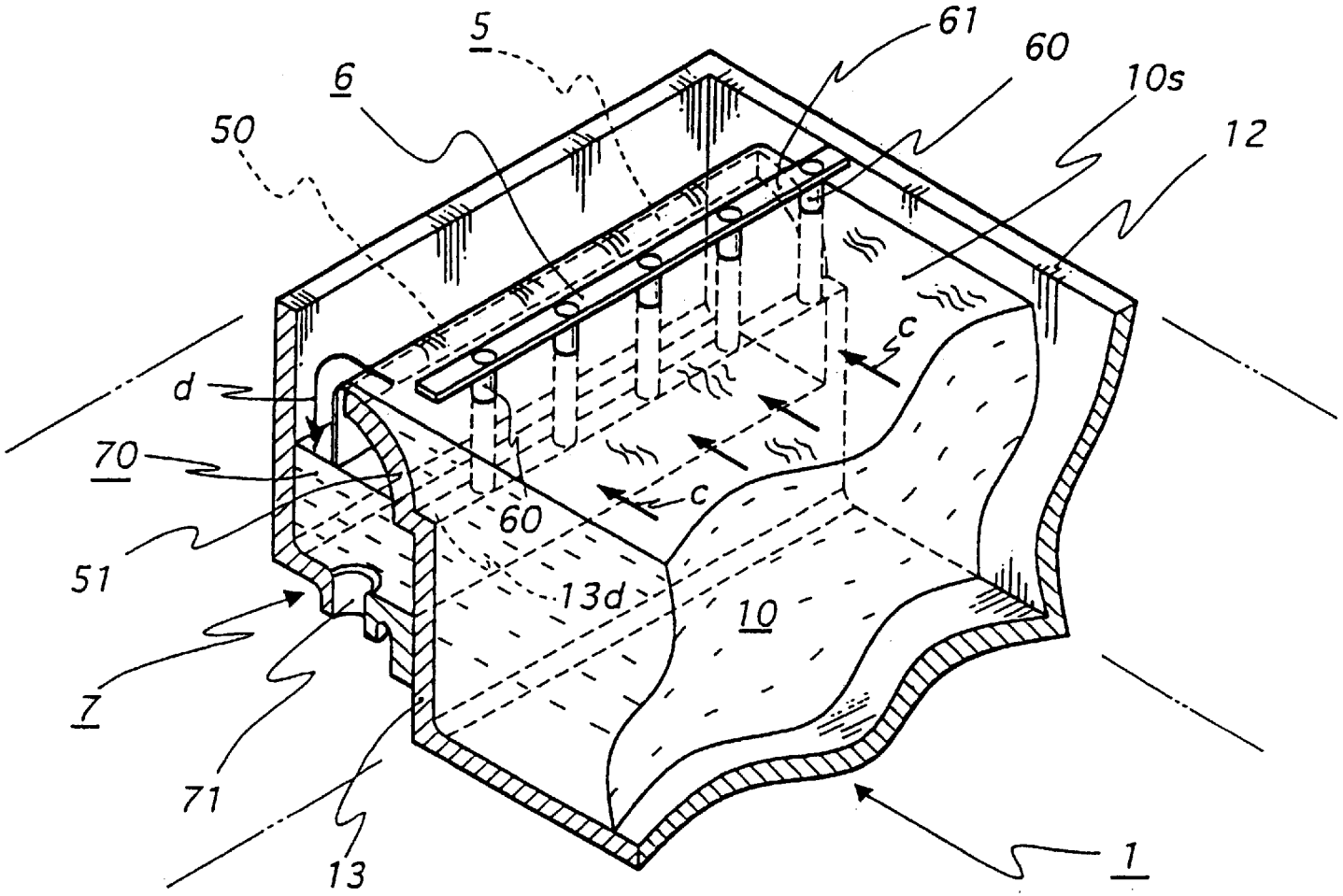
FIG. 3 is a perspective view illustrating a downstream part of the swimming pool, shown in FIG. 1.
Figure 4A:
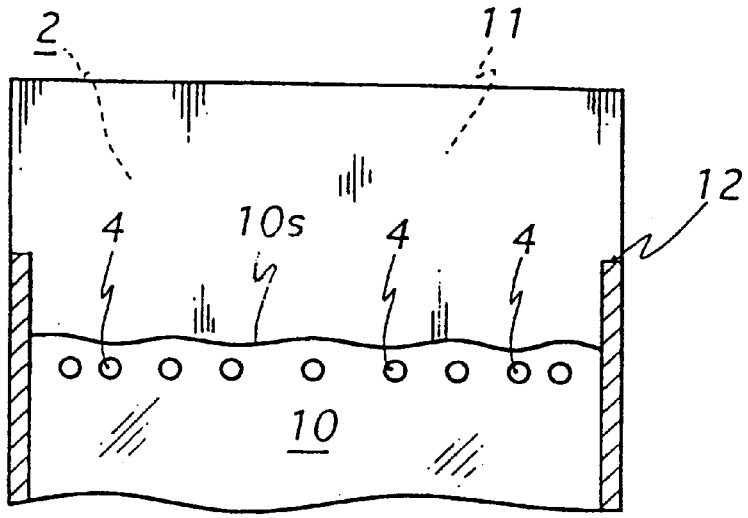
FIGS. 4A to 4C are front views each illustrating an example of water supply openings according to the present invention.
Figure 4B:
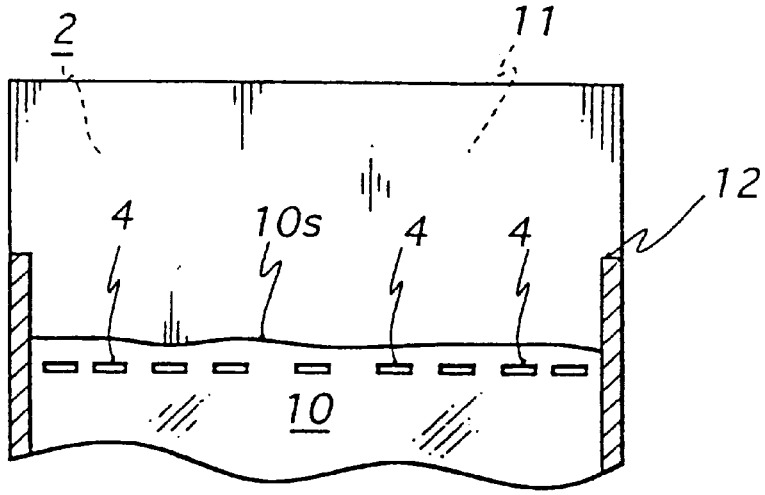
Figure 4C:
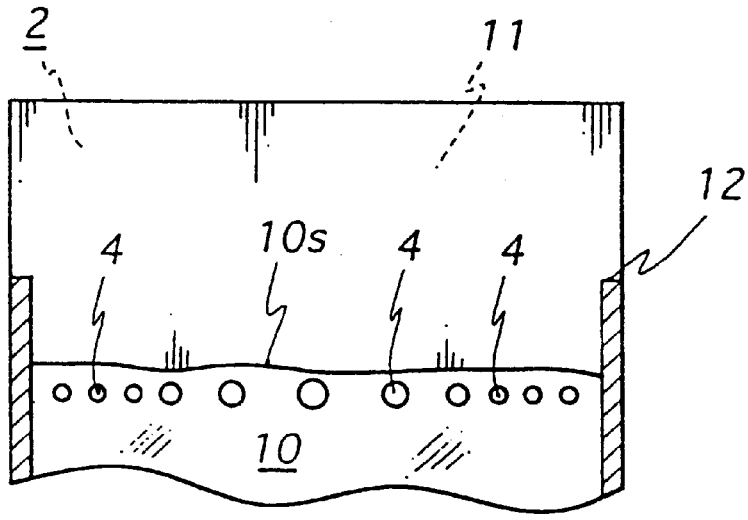

FIG. 1 is a side view (partly cross-sectional) illustrating a swimming pool according to a preferred embodiment of the present invention. FIG. 2 is a perspective view illustrating an upstream part of the swimming pool, shown in FIG. 1. FIG. 3 is a perspective view illustrating a downstream part of the swimming pool, shown in FIG. 1. FIGS. 4A to 4C are front views each illustrating an example of water supply openings according to the present invention.

In the drawings, a reference numeral "1" represents a swimming tank (swimming pool), which stores swimming water 10 therein. The swimming tank 1 is shaped to be square and to have a length (flowing direction), corresponding to about two or three times of the high of a man, a width of about 1.5 m to 3.0 m, which is wide enough for swimming, and a depth of about 1.0 m to 1.5 m. The swimming tank 1 may be made of a material such as concrete, FRP, expanded synthetic resin, stainless steel, iron, non-steel plate, or the like.

The swimming tank 1 is provided at an end (upstream end) with an upstream tank (storage tank) 2. The upstream tank 2 is formed out of an upstream side wall 11 of the swimming tank 1 in one body. The upstream tank 2 is structured to be closed. The upstream tank 2 is filled with stored-up water 20, of which the energy head "H" is higher than that of a surface 10*s* of the swimming water 10 in the swimming tank 1. The energy head "H" includes position head and pressure head.

For example, a surface 20*s* of the stored-up water 20 in the upstream tank 2 is determined to be higher than the surface 10*s* of the swimming water 10 in the swimming tank 1; and/or the total energy head of the stored-up water 20 in the upstream tank 2 is set to be higher than the position head of the swimming water 10 in the swimming tank 1 by applying a predetermined amount of pressure to the stored-up water 20.

The upstream tank 2 is provided at a top 21 with a valve 22 for taking out air remaining in the upstream tank 2. When the upstream tank 2 is pressured, air remaining around the top 21 goes out through the valve 22. The upstream tank 2 is connected through a pipe 30 to a pump 3.

The upstream tank 2, in this embodiment, is of closed type and can be applied with pressure, however, the tank 2 can be an open type. The upstream tank 2 is designed to have a position head that is higher than that of the swimming tank 1.

Referring to FIG. 2, the upstream wall 11 of the swimming tank 1 is provided with a number of openings (water supply openings) 4. Each of the openings 4 extends through between the upstream tank 2 and the swimming tank 1. On the upstream wall 11, the openings 4 are arranged on a line that is extending just below the surface 10*s* of the swimming water 10 horizontally (in the direction of width) end to end.

As shown in FIG. 4A, the openings 4 are arranged to have an optimum distance between two adjacent openings, the distance being not uniform throughout in the horizontal direction. The distance is determined, in the horizontal direction, to be wider around the center of the swimming tank 1 and be narrower around side walls of the swimming tank 1. Each of the openings 4 can be shaped to be round, as shown in FIG. 4A, or to be square (slits), as shown in FIG. 4B.

Further, each of the openings 4 may be designed to have an optimum area, which is not uniform throughout in the horizontal direction, as shown in FIG. 4C. The area of each opening 4 may be determined, in the horizontal direction, to be larger around the center of the swimming tank 1 and be smaller around the side walls of the swimming tank 1.

Although, in this embodiment, the upstream tank 2 and the swimming tank 1 are united with each other, they can be formed separately as long as the upstream tank 2 has a higher energy head. If the swimming tank 1 and the upstream tank 2 are structured separately, the upstream tank 2 should be connected through pipes to the openings 4.

Now referring to FIG. 3, the swimming tank 1 is provided at the other end (downstream end) with a weir 5 having a ridge 50, which is positioned little lower than a top 12 of the side walls of the swimming tank 1. The weir 5 extends throughout in the width (horizontal) direction. The weir 5 is formed by a weir plate 51 shaped to have the ridge 50, which is curved upwardly toward the downstream.

In the swimming tank 1, a protecting fence 6 is provided at an upstream side of the weir 5. The protecting fence 6 includes a plurality of poles 60 and a support member 61. The poles 60 are fixed at the bottom ends onto a step 13*d*, which is a part of a downstream wall 13. The step 13*d* is located in a level, from which the weir plate 51 is curving. The poles 60 are arranged so as to have an appropriate interval (spacing), nobody can pass through them. The top ends of the poles 60 extend vertically out of the surface 10*s* of the swimming water 10. The support member 61 is put at the ends on the top 12 of the side wall of the swimming tank 1. The support member 61 supports the top ends of the poles 60.

According to the present invention, other types of protector can be used for protecting the user from being flowed over the weir 50 toward a downstream tank 7. For instance, a protecting net (not shown) can be arranged above the weir ridge 50 to cover the top of the downstream tank 7.

The downstream tank (receiving storage tank) 7 is provided at the downstream side of the weir 5 so as to receive the water flowing over the weir 5. The downstream tank 7 is designed to have a width corresponding to the width of the weir 5 and have a capacity that is enough to store the water flowing from the swimming tank 1 for a predetermined period of time. The downstream tank 7 can be structured separately from the swimming tank 1, or can be united with the swimming tank 1.

The downstream tank 7 is provided at the bottom with a drain opening 71. Water stored in the downstream tank 7 is returned through the drain opening 71 toward the pump 3. As shown in FIG. 1, the drain opening 71 is connected through a pipe 8 to the pump 3 via a filter 80, a sterilizer 81 and a heater 82. The filter 80, sterilizer 81 and heater 82 do not have to be used always. The filter 80 cleans up the water supplied through the pipe 8. The sterilizer 81 sterilizes the water. The heater 82 controls the water to be supplied into the swimming tank 1. The filter 80, sterilizer 81 and heater 82 can be fabricated in accordance with the conventional technology, and the detailed description thereof is omitted in this specification.

The above described embodiment operates as follows:

First, enough amount of water is stored each in the swimming tank 1, upstream tank 2 and downstream tank 3, in advance of use. Then, the pump 3 is driven to circulate the water in those three tanks 1, 2 and 7, as indicated by an arrow "a". When the pump 3 is driven, the remaining air in the upstream tank 2 is pushed out of the valve 22 with the pressure of the stored-up water 20. In the upstream tank 2, the stored-up water 20 is applied with an appropriate level of pressure. Therefore, the energy head of the stored-up water 20 in the upstream tank 2 includes the position head and pressure head.

As the stored-up water 20 in the upstream tank 2 has an energy head that is higher than the swimming water 10 in the swimming tank 1, the stored-up water 20 in the upstream tank 2 is injected into the swimming tank 1 in accordance with the difference (H) of energy head between those two tanks 1 and 2. The injected water is indicated by an arrow "b" in FIG. 1. The injected water makes water current, which is not in a spiral state but in a laminar flow (streamline flow) state, as indicated by an arrow "c". In the swimming tank 1, the water current (laminar flow) travels along the surface 10*s* of the swimming water 10 toward the downstream tank 7.

As the distance of the openings 4 is determined to be wider around the center of the swimming tank 1 and be narrower around the sides, more amount of water flows around the sides of the swimming tank 1. Further, the area of each opening 4 is determined to be larger around the center of the swimming tank 1 and be smaller around the sides of the swimming tank 1, so that the water current tends to run at a higher speed around the sides of the swimming tank 1. As a result, frictional drag made around the side walls is cancelled, and therefore, the water current runs at a uniform speed throughout the swimming tank 1 in the width direction.

When the water streamed in the swimming tank 1 is flowed over the weir 5, as indicated with an arrow "d", the flowed-over water is stored in the downstream tank 7 for a while. As the weir 5 (51) is provided with the weir ridge 50, which is curved upwardly, the streamed water is smoothly guided into the downstream tank 7. In other words, the streamed water is prevented from being reflected at the weir 5. Therefore, the water current in the swimming tank 1 is prevented from being disturbed by reflection current.

The protector fence 6 protects the user in the swimming tank 1 from being accidentally flowed over the weir 5 toward the downstream tank 7, especially when the user is tired.

The water 70 stored in the downstream tank 7 is drained from the drain opening 71 and is returned to the pump 3 through the pipe 8, filter 80, sterilizer 81 and heater 82, as indicated with an arrow "e", so that the water is circulated in the swimming pool system.

As described above, according to the present invention, the water is once stored in the upstream tank 2 and is injected into the swimming tank 1 in accordance with the difference of energy head between the stored-up water 20 and the swimming water 10. As a result, the injected water makes water current that is not in a spiral state but in a laminar flow (streamline flow) state. Therefore, a well-regulated steam of water can be provided along the surface 10*s* of the swimming water 10.

As the upstream tank 2 is pressured, a pressure head is applied to the stored-up water 20 and the energy head of the stored-up water 20 is increased. In addition, the pressure in the upstream tank 2 is controlled by the pump 3 to be able to obtain the optimum flow rate in the swimming tank 1.

The stored-up water 20 in the upstream tank 2 is injected not only by the power of the pump 3 but also by the energy head thereof; and therefore, the pump 3 can be designed to have a smaller capacity.

As the distance and/or area of the openings 4 is determined not to be uniform, the water current in the swimming tank 1 runs at a uniform speed throughout in the width direction.

As the weir 5 is provided with the weir ridge 50, which is curved upwardly, the streamed water is prevented from being reflected at the weir 5; and therefore, the water current in the swimming tank 1 is prevented from being disturbed by reflection current.

What is claimed is:

1. A swimming pool, in which water is circulated, comprising:

a swimming tank which stores water for swimming;

an upstream tank which stores water to be supplied into the swimming tank, in which the water in the upstream tank has an energy head that is higher than the water in the swimming tank so as to generate water current in the swimming tank, the upstream tank provided with an air escape valve through which air remaining in the upstream tank after start-up is pushed out while water within the upstream tank maintains the energy head;

a downstream tank which stores the water streamed from the upstream tank through the swimming tank; and a pump which forces the water stored in the downstream tank to the upstream tank.

2. A swimming pool according to claim 1, wherein the energy head comprises at least one of the position head and pressure head of the water.

3. A swimming pool according to claim 1, further comprising:

at least one supply opening which is arranged between the upstream tank and swimming tank so that the water stored in the upstream tank is injected therethrough and around the surface of the water in the swimming tank.

4. A swimming pool according to claim 3, wherein the at least one supply opening comprises a plurality of openings which are arranged on a horizontal line with a distance between adjacent openings, which is not uniform throughout in the horizontal direction.

5. A swimming pool according to claim 1, further comprising:

a weir which is arranged at the downstream end of the swimming tank, wherein the downstream tank stores the water streamed over the weir.

6. A swimming pool according to claim 5, wherein the weir is shaped to have a top which is curved upwardly.

7. A swimming pool according to claim 5, further comprising:

a protector which is arranged at the upstream end of the weir so that the user in the swimming tank is protected from being flowed over the weir toward the downstream tank.

8. A swimming pool according to claim 1, further comprising:

a filter arranged on the water way between the downstream tank and the upstream tank to clean up the circulated water;

a sterilizer arranged on the water way between the downstream tank and the upstream tank to sterilize the circulated water; and a heater arranged on the water way between the downstream tank and the upstream tank to control the temperature of the circulated water.

9. A swimming pool, in which water is circulated, comprising:

a swimming tank which stores water for swimming;

an upstream tank which stores water to be supplied into the swimming tank, in which the water in the upstream tank has an energy head that is higher than the water in the swimming tank so as to generate water current in the swimming tank, the upstream tank being provided with an air escape valve through which air remaining in the upstream tank after start-up is pushed out while water within the upstream tank maintains the energy head;

at least one supply opening which is arranged between the upstream tank and the swimming tank so that the water in the upstream tank is supplied therethrough and around the surface of the water in the swimming tank;

a weir which is arranged at the downstream end of the swimming tank;

a downstream tank which stores the water streamed over the weir; and a pump which forces the water stored in the downstream tank to the upstream tank.

10. A swimming pool according to claim 9, wherein the energy head comprises at least one of the position head and pressure head of the water.

11. A swimming pool according to claim 9, wherein the weir is shaped to have a top which is curved upwardly.

12. A swimming pool according to claim 9, further comprising:

a protector which is arranged at the upstream end of the weir so that the user in the swimming tank is protected from being flowed over the weir toward the downstream tank.

13. A swimming pool according to claim 9, further comprising:

a filter arranged on the water way between the downstream tank and the upstream tank to clean up the circulated water;

a sterilizer arranged on the water way between the downstream tank and the upstream tank to sterilize the circulated water; and a heater arranged on the water way between the downstream tank and the upstream tank to control the temperature of the circulated water.

14. A swimming pool according to claim 9, wherein the at least one supply opening comprises a plurality of openings which are arranged on a horizontal line with a distance between adjacent openings, which is not uniform throughout in the horizontal distance.

* * * * *